US006752213B1

(12) United States Patent
van der Poel

(10) Patent No.: US 6,752,213 B1
(45) Date of Patent: Jun. 22, 2004

(54) FLOATING OFFSHORE CONSTRUCTION, AND FLOATING ELEMENT

(75) Inventor: Hans van der Poel, Rockanje (NL)

(73) Assignee: Buitendijk Holding B.V., Le Zwindjdrecht (NL)

( * ) Notice: Subject to any disclaimer, the term of this patent is extended or adjusted under 35 U.S.C. 154(b) by 0 days.

(21) Appl. No.: 09/913,620

(22) PCT Filed: Feb. 16, 2000

(86) PCT No.: PCT/NL00/00096

§ 371 (c)(1),
(2), (4) Date: Nov. 14, 2001

(87) PCT Pub. No.: WO00/48899

PCT Pub. Date: Aug. 24, 2000

(30) Foreign Application Priority Data

Feb. 16, 1999 (NL) ..... 1011312

(51) Int. Cl.[7] ..... E21B 29/12
(52) U.S. Cl. ..... 166/355; 405/224.2
(58) Field of Search ..... 166/355, 352, 166/350; 405/224.3, 224.4, 224.2

(56) References Cited

U.S. PATENT DOCUMENTS

| | | | | |
|---|---|---|---|---|
| 3,017,934 A | | 1/1962 | Rhodes et al. | |
| 3,354,951 A | | 11/1967 | Savage et al. | |
| 3,858,401 A | | 1/1975 | Watkins | |
| 3,952,526 A | * | 4/1976 | Watkins et al. | 405/224.2 |
| 3,955,621 A | * | 5/1976 | Webb | 166/355 |
| 4,557,332 A | * | 12/1985 | Denison et al. | 166/345 |
| 4,913,238 A | * | 4/1990 | Danazcko et al. | 405/223.1 |
| 6,470,969 B1 | * | 10/2002 | S.o slashed.rhaug et al. | 166/355 |

* cited by examiner

*Primary Examiner*—Hoang Dang
(74) *Attorney, Agent, or Firm*—Weingarten, Schurgin, Gagnebin & Lebovici LLP

(57) ABSTRACT

A floating offshore construction (1) comprising a suspension gear (7) for suspending a riser construction (6). The suspension gear comprises a guide which extends adjacent the water surface during use, with a float (12) disposed therein for axial movement. The float comprises coupling means (13) for coupling to a riser construction. The invention also relates to a float.

9 Claims, 5 Drawing Sheets

FLOATING OFFSHORE CONSTRUCTION, AND FLOATING ELEMENT

Figure 1:
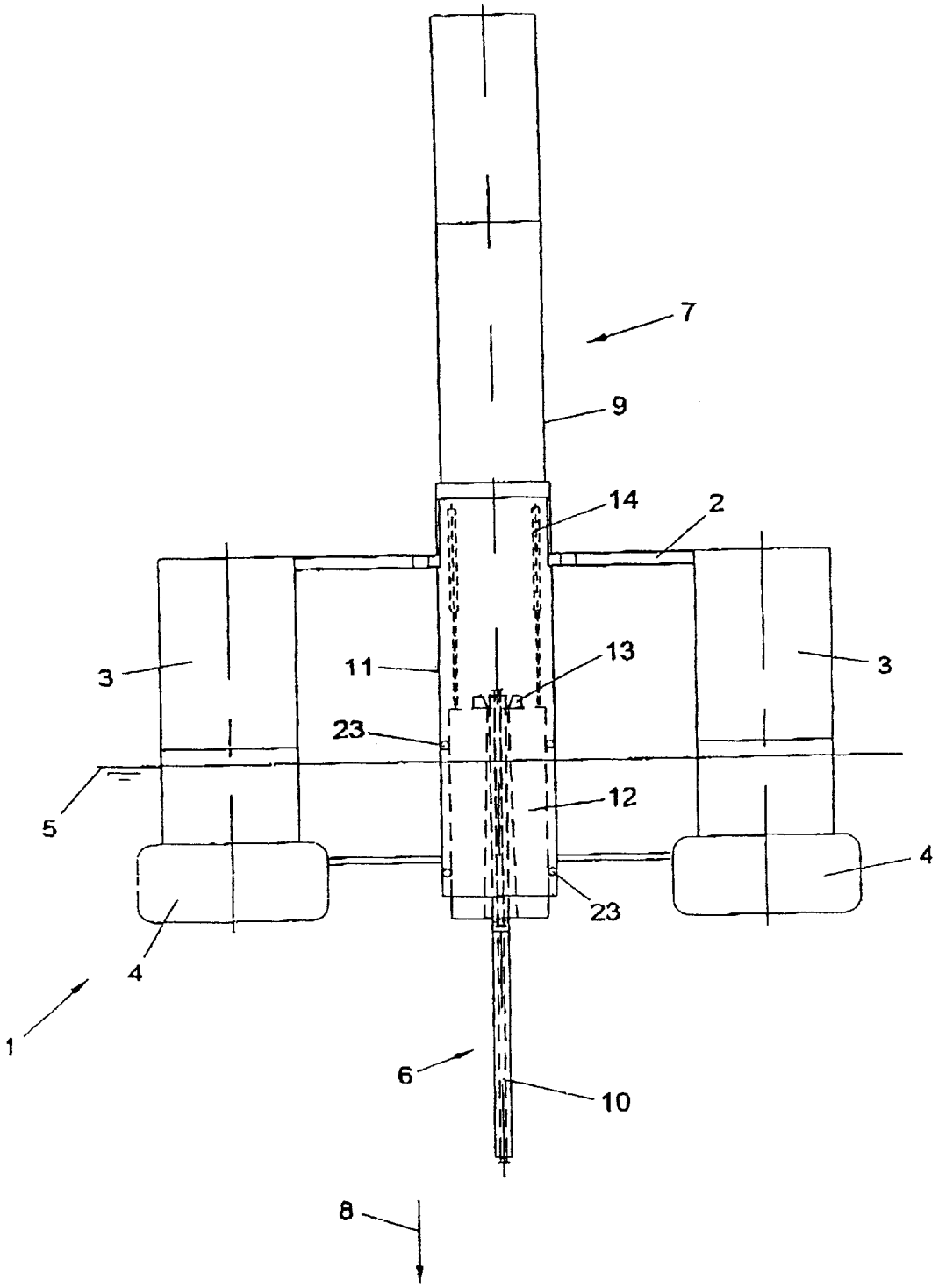

The invention relates to a floating offshore construction, comprising a suspension gear for suspending a riser construction, the suspension gear being arranged to transmit downward force exerted by a riser construction on the offshore construction and comprising a hoisting gear or supporting the riser construction and a guide which, during use, extends adjacent the water surface.

Such an offshore construction is known from U.S. Pat. No. 3,858,401 and comprises a hoisting gear for supporting a riser construction built up of a plurality of gas receiving, buoyant chambers.

U.S. Pat. No. 3,017,934 discloses a floating offshore construction having a telescopic union for a riser construction which is not arranged to transmit downward force, comprising a guide which, during use, extends adjacent the water surface with a float that is connected to a riser construction. In use, the telescopic union can be extended from the float fixed to the upper segment of the riser construction by axially moving the guide into a tubular column suspended from the offshore construction.

The offshore construction according to U.S. Pat. No. 3,858,401 is used for the offshore exploitation and preparation for exploitation of submarine wells of natural resources in places where the seabottom lies relatively deep below the water surface. To be able to reach a well, the floating offshore construction, often a drilling ship or a semi-submersible, is positioned on the water surface above the well. Next, from the buoyant offshore construction, a riser pipe is lowered which is coupled to a stop it valve already provided on the seabottom, the riser forming a guarded conduit through which, for instance, during preparing the well for exploitation, drilling tools can be lowered and, during the exploitation, natural resources can be conveyed from the well to the offshore construction without these resources contacting water.

The riser construction is typically built up from riser segments which, are coupled during lowering and detached again during raising. Usually, this involves up or down displacement respectively of the riser construction over the length of one pipe segment by means of a hoisting gear forming part of the suspension gear. Due to the relatively great depth of the seabottom relative to the water surface, the offshore construction cannot, as in the case of a non-floating offshore construction, be supported by legs on the seabottom, but is buoyantly positioned above the well by means of ground anchors or dynamic positioning means. To enable the offshore construction to follow wave movements of the water surface relative to the riser construction, the suspension gear usually comprises a clamp coupling for receiving the riser construction which is connected to the offshore construction by means of telescopic cylinders and/or a tensioning system designed as cables running along pulleys, the suspension gear transmitting the downward force exerted by the lowered riser construction on the offshore construction. The offshore construction must have sufficient buoyancy to be able to compensate the downward force exerted by the riser.

Because of exhaustion of wells located in places where the bottom is relatively shallow, it is increasingly important to be also able to exploit and prepare for exploitation wells that are located in places where the seabottom is relatively deep. In particular, it is presently desired that it be possible to exploit wells located in places where the seabottom lies more than 1500 m below the water surface.

This entails the problem that the longer riser constructions required therefor exert a greater downward force on the offshore construction, so that the suspension gear should be of heavier design and the offshore construction should have a greater buoyancy. In practice, this leads to a considerable increase of the manufacturing costs and the operational costs of the offshore gear.

The object of the invention is to provide an offshore construction of the type mentioned in the preamble that does not have the above drawbacks. To that end, the offshore construction according to the invention comprises a suspension gear for suspending a riser construction, the suspension gear being arranged to transmit downward force exerted by a riser construction on the offshore construction and comprising a hoisting gear for supporting the riser construction and a guide which, during use, extends adjacent the water surface, characterized in that, the suspension gear further comprises a float arranged for axial movement in the guide, the float being provided with a coupling device for receiving the riser construction and in that the suspension gear further comprises a length-adjustable connecting device connecting the guide to the float. The effect achieved by the additional buoyancy of the float is that the downward force exerted on the floating offshore construction by the riser construction via the suspension gear can be reduced considerably, so that the suspension gear can be of a simpler design and the buoyancy of at the offshore construction can be smaller. Due to the axially movable arrangement of the float, it can move back and forth along the guide, when it is coupled to a riser construction, allowing the floating offshore construction to follow wave movements of the water surface. Further, by the guide, horizontal forces can be absorbed between the offshore construction and the riser construction, i.e. forces substantially in or parallel to the water surface, for instance due to current or wind. As a result, a vertically adjustable connection between the riser or the float and the offshore construction can be of a considerably simpler design, since it will now be substantially loaded in vertical direction or substantially transversely to the water surface.

In an advantageous embodiment, the guide comprises a conduit and the float comprises an elongated sleeve which is provided with a floating chamber and accommodated in the conduit for axial movement. The effect thus achieved, inter alia, is that transverse to the direction of movement, a proper power transmission is possible between the float and the offshore construction and that a reliable guidance can be realized in a simple manner. In particular, in this embodiment, the above-mentioned transmission of transverse forces can be realized highly effectively.

In another embodiment, the floating chamber is accommodated in the guide so as to be secured against axial rotation. The effect thus achieved is that the chance of accumulated torsion of the riser construction caused by the offshore construction following wave movements of the water surface, can be reduced.

In yet another embodiment, the offshore construction according to the invention is characterized in that the floating chamber is provided with controllable ballast means. The effect thus achieved is that an upward or downward movement of the riser construction relative to the offshore construction can be supported. This is in particular advantageous during upward or downward movement of the riser relative to the offshore construction during the assembly or disassembly of a riser construction built up from riser segments.

In a further embodiment, the offshore construction according to the invention is characterized in that the floating element has a central bore for guiding the riser therethrough. The effect thus achieved, inter alia, is that the riser construction, during lowering, can be lowered at a predetermined angle. Preferably, the central bore has sidewalls which, relative to the longitudinal axis of the guide, diverge in downward direction at an angle of 1–6°, preferably about 3°. To reduce the chance of damage to the riser construction by the sidewalls, the sidewalls may be provided with a protection, for instance a rubber lining.

In again another embodiment, the float is detachably connected to the guide. The effect thus achieved is that the offshore construction can be uncoupled from the float with the riser construction. In particular, the riser construction with the float can thus buoyantly remain behind above the well, while the offshore construction with the guide can be displaced as separate unit.

In again another embodiment, the offshore construction according to the invention comprises a guide which is height-adjustable to a position above the water surface. The effect thus achieved is that when no riser construction is present, the guide can be adjusted to a position above the water surface, so that during travel, a more favorable flow resistance can be obtained. The invention also relates to a float.

Figure 2B:
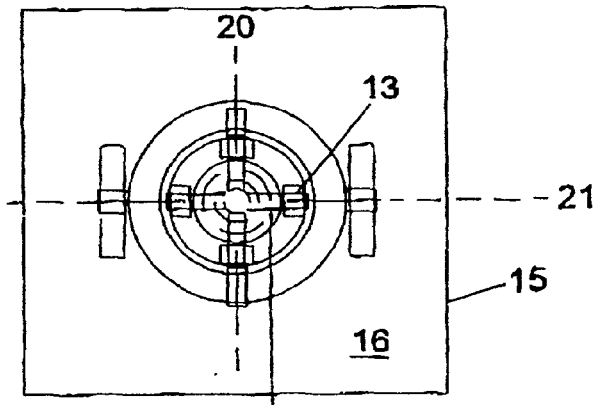
Figure 2A:
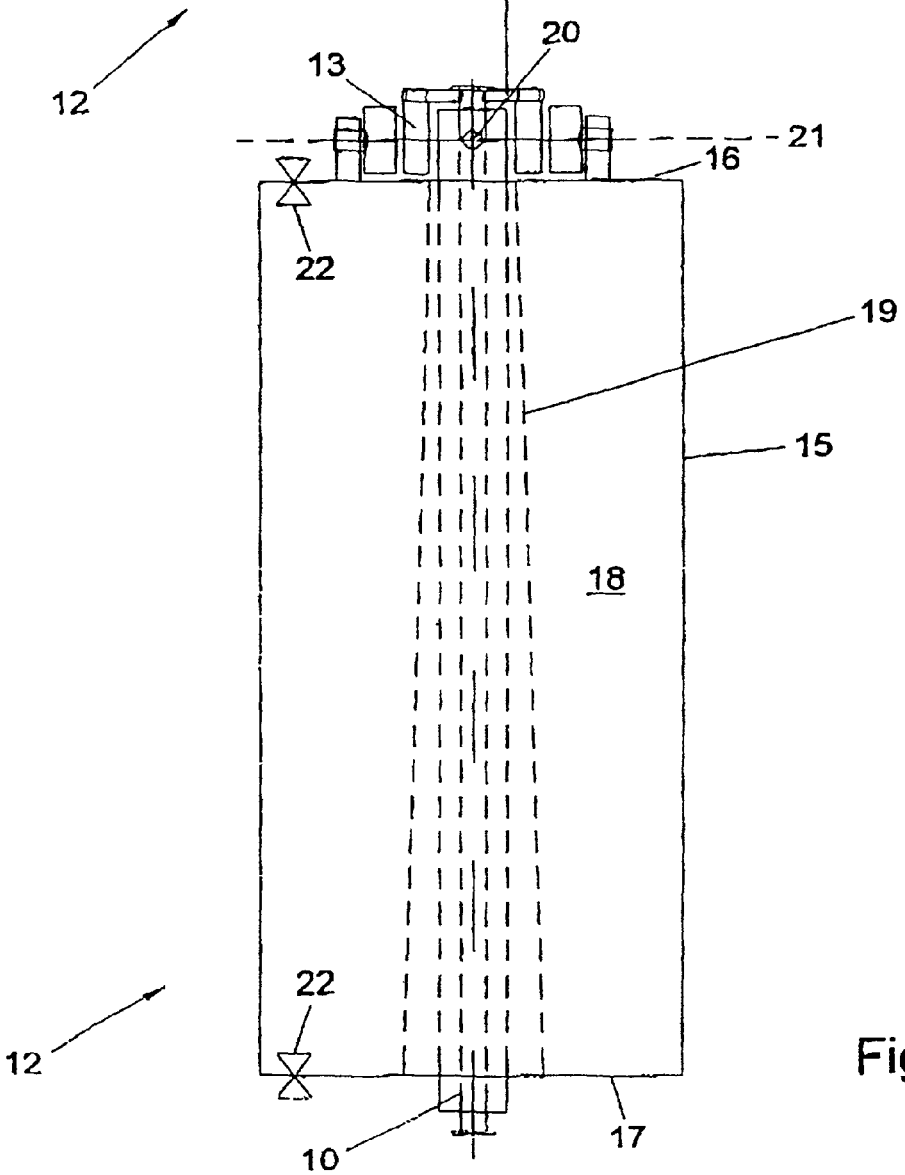
Figure 3C:
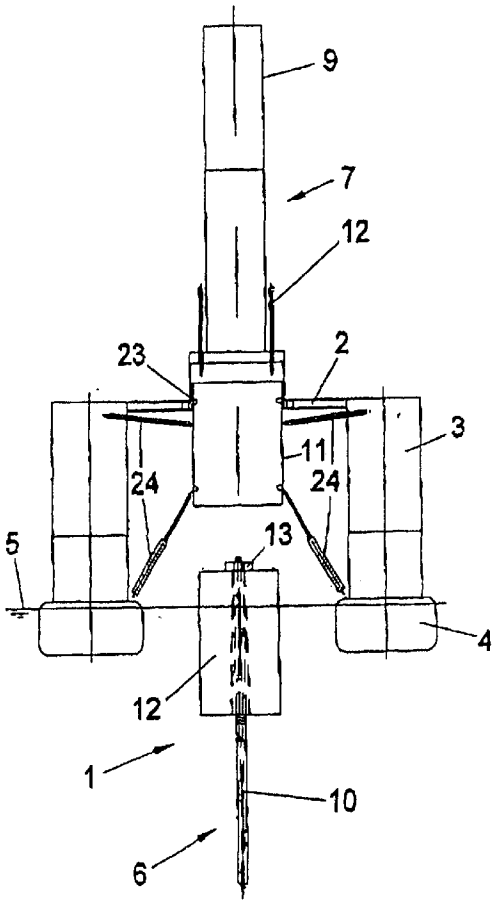
Figure 3B:
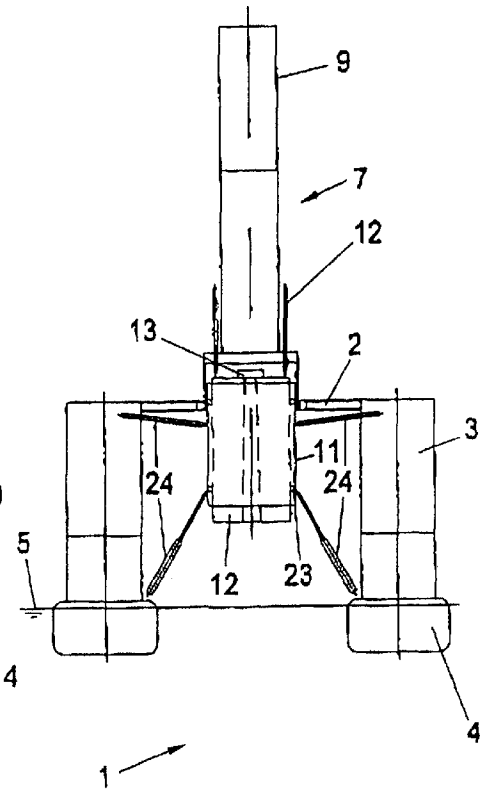
Figure 3A:
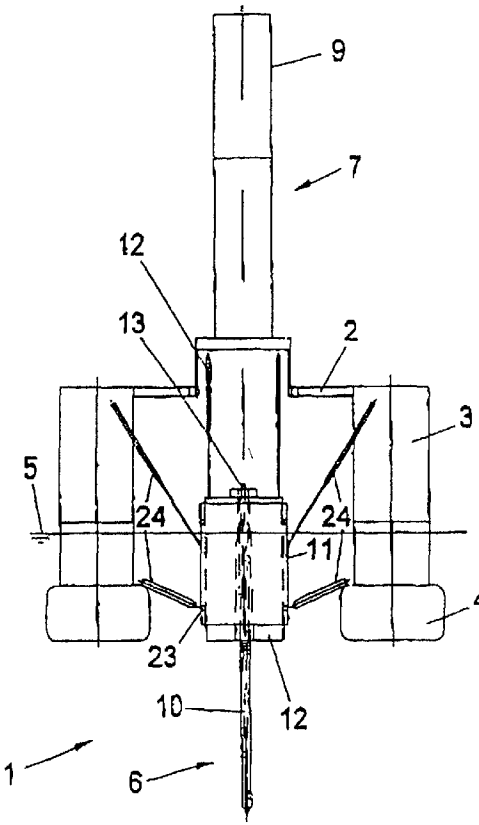
Figure 4:
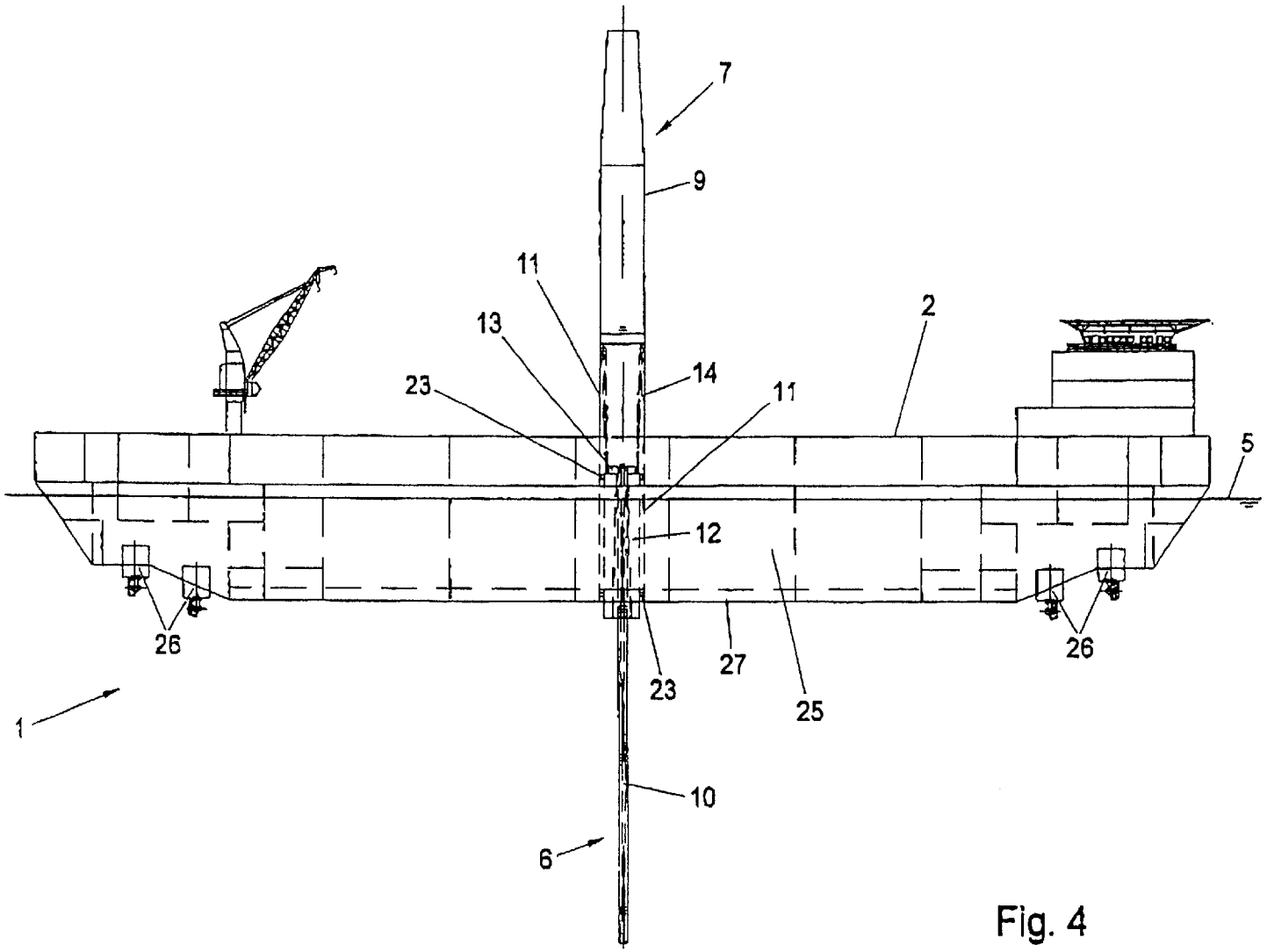
Figure 5:
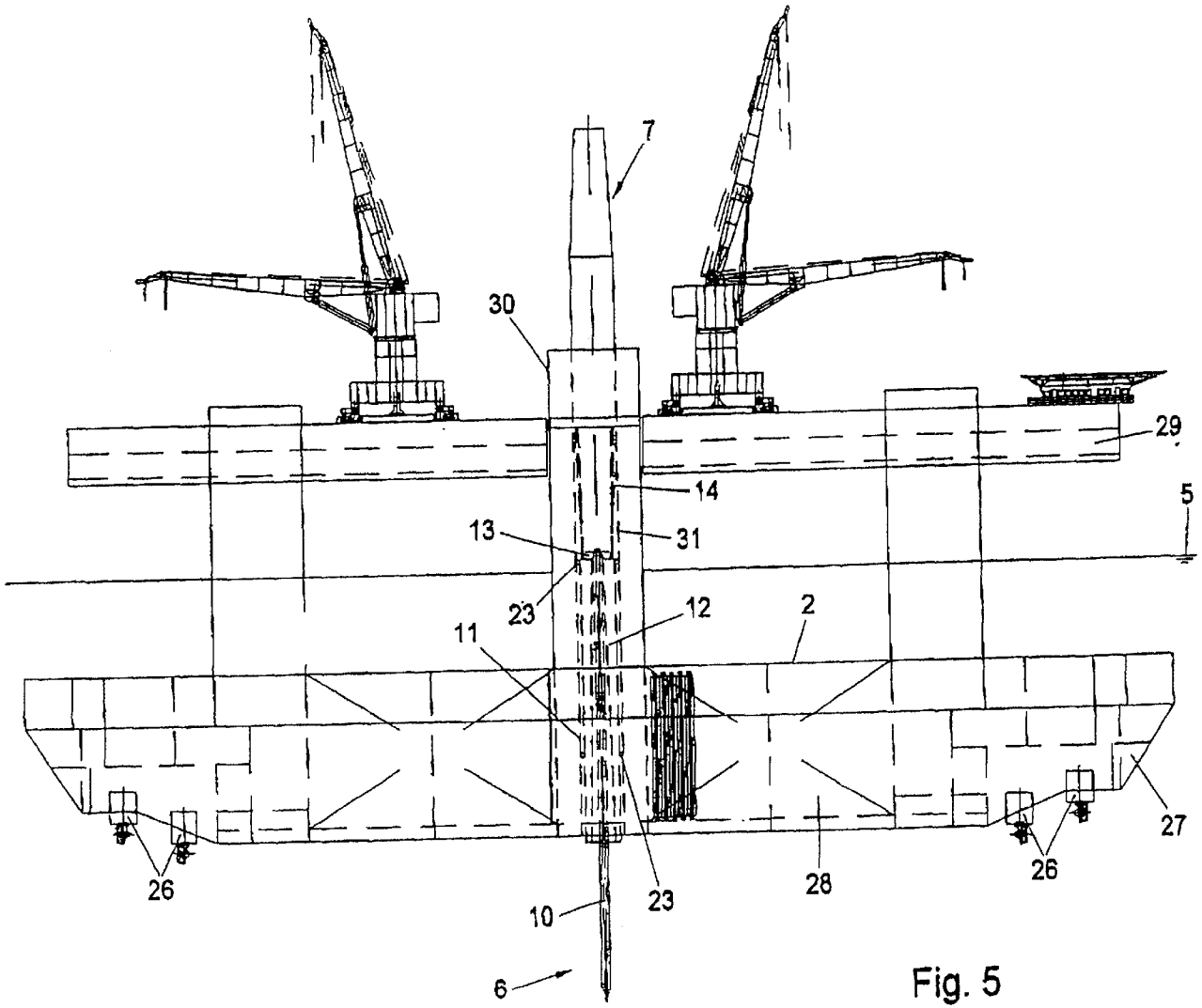

Hereinafter, the invention will be specified with reference to a number of exemplary embodiments shown in a drawing. In the drawing:

FIG. 1 is a schematic front view of a first embodiment of a floating offshore construction according to the invention;

FIG. 2*a* is a schematic front view of the float of the offshore construction of FIG. 1;

FIG. 2*b* is a schematic top plan view of the float of FIG. 2*a*;

FIGS. 3*a*, 3*b* and 3*c* are each schematic front views of a second embodiment of a floating offshore construction according to the invention in, respectively, operating position, transport position and uncoupled position;

FIG. 4 is a schematic side elevation of a third embodiment of a floating offshore construction according to the invention; and FIG. 5 is a schematic side elevation of a fourth embodiment of a floating offshore construction according to the invention.

It is observed that the Figures are merely schematic representations of preferred embodiments of the invention. In the Figures, corresponding or identical parts are designated by the same reference numerals.

FIG. 1 shows a floating offshore construction 1, designed as semi-submersible. The semi-submersible comprises a working deck 2 connected to floats 4 by means of legs 3. By means of the floats 4, the semi-submersible 1 can be sunk from a transport position, in which the floats are normally located at least partially above the water surface 5, into the semi-sunk operating position shown in the Figure, in which the floats 4 are located below the water surface 5. In the operating position shown, the semi-submersible still floats on the water surface, but it will follow wavings of the water surface 5 less quickly. In this operating position, a riser construction 6 can be lowered, by means of the suspension gear 7, from the working deck 2 down to the seabottom, in the direction of the arrow 8.

The suspension gear 7 comprises a hoisting gear of the conventional type, accommodated in the derrick 9. By means of the hoisting gear, segments 10 of the riser construction can be supplied from the working deck 2 in a manner known per se, to be coupled to form a riser construction 6 in a manner which will be described in more detail hereinbelow. The suspension gear comprises a guide 11 which, at least during the operating position, is located adjacent the water surface and extends substantially transversely thereto. In this exemplary embodiment, the guide 11 is designed as a conduit of rectangular section A float is accommodated in the guide 11 for axial movement, i.e. movement substantially transverse to the water surface 5. The float 12 is provided with a coupling device 13 for coupling to the riser construction 6.

By means of a length-adjustable connecting device 14, the float 12 is connected to the guide 11, here designed as a telescopic connecting device Referring to FIGS. 2*a* and 2*b*, the float 12 is shown therein. The float 12 comprises a sleeve 15 of rectangular section, which sleeve 15 is closed adjacent its top side 16 and bottom side 17 to form a floating chamber 18. The rectangular section of the sleeve 15 effects that the float 12 is included in the guide 11 so as to be secured against axial rotation. The float 12 is provided with a central bore 19 for guiding the segments 10 of the riser construction 6 therethrough. By means of the coupling device 13, the float 12 can be clamped down on the upper segment 10 of the riser construction 6 through clamping. Of course, other coupling methods may also be applied. By giving the coupling device 13 a cardan construction, the effect achieved is that a clamped riser construction 6 can pivot slightly relative to the float 12 about the pivotal axes 20 and 21. Since the central bore extends substantially transversely to the water surface 5 and has sidewalls which, relative to the longitudinal axis of the bore, diverge at an angle of about 3° in the direction of the arrow 8, it is provided is that during lowering, the successive segments 10 of the riser construction 6 are guided downwards at the proper angle.

In this embodiment, riser segments as described in Dutch patent application 1008311 can advantageously be used, as they do not only have a buoyancy of their own, but are also guarded adjacent the outer circumference, to enable a proper cooperation with the sidewalls of the guide.

The floating chamber 12 is provided with controllable ballast means 22 shown schematically in the Figure, whereby the resulting upward force on the float 12 can be controlled. By designing the controllable ballast means 22 as valves for supplying and discharging compressed air and water, the effect achieved is that they can be realized in a simple manner. By the controllable ballast means 22, an upward and downward movement of the float 12 within the guide 11 can be supported. By including the float 12 in the guide 11 by means of guide wheels 23 or similar guide members, the axial movement of the float 12 within the guide 11 can be facilitated.

In the operating position shown in FIG. 1, the riser construction 6 is connected to the float 12 by means of the coupling device 13 The float 12 produces an upward force which can compensate the downward force caused by the riser construction 6 considerably. Thus, the suspension gear 7, in particular the telescopic connecting device 14 and the hoisting gear, as well as the entire construction of the semi-submersible, can be of a considerably lighter design and the buoyancy of the floats 4 can be chosen to be considerably smaller. Moreover, the guide 11 absorbs forces substantially in or parallel to the water surface 5, so that the telescopic connecting device is loaded substantially transversely to the water surface 5 and can of a considerably simpler design. In particular, the operation of having the telescopic cylinders, disposed on opposite sides of the riser, retract and extend to an equal extend can thus be simplified considerably. It is observed that via such guide, the connection of the riser to the offshore construction can already be advantageously employed in itself, i.e. without float.

With reference to FIGS. 3*a*, 3*b* and 3*c*, a second embodiment of the floating offshore construction 1 according to the invention is shown therein. Here, too, the floating offshore construction 1 is designed as semi-submersible FIG. 3*a* shows the semi-submersible in the operating position, while FIG. 3*b* shows the semi-submersible in the transport position. By means of telescopic cylinders 24, the guiding device 11 is connected to the offshore gear so as to be height-adjustable to a position above the water surface 5. Of course, other types of adjustable connecting means can likewise by used. In the transport position, the guiding device 11 can be lifted with the float 12 to a position above the water surface, so that the flow resistance during transport can be reduced and the risk of the offshore construction 1 keeling over can be decreased. Further, in this embodiment, the float 12 is detachably connected to the guide 11 by coupling means, so that from the operating position shown in FIG. 3*a*, the float 12 can be uncoupled and the floating offshore construction 1 can be brought into the operating position and can be displaced with lifted guide 11, while leaving behind the float 11. It will be understood that the detachable connection between the float and the guide or the offshore construction can also be applied to other structural variants.

With reference to FIG. 4, a third structural variant of a floating offshore construction according to the invention is shown therein. In this variant, the floating offshore construction is designed as a drill ship. The drill ship comprises a hull 25 and drive means 26 The hull 25 is of the type conventional for ships and is provided with a guide conduit 11 which extends substantially transverse to the water line 5 and in which is float 12 is included for axial movement. In this structural variant, the operation of the float 12 is substantially the same as discussed with reference to FIGS. 1 and 2*a* and *b*. When no riser construction 6 is coupled to the float 12, it can be lifted to a position above the bottom 27 of the hull 25, supported by the controllable ballast means 22 and by means of the telescopic connecting means 14, after which the guide conduit 11 can be closed adjacent the bottom 27 by means of shut-off means, not shown, in order to reduce the flow resistance of the hull 25 during travel.

With reference to FIG. 5, a floating offshore construction 1 is shown therein, designed as working ship. The working ship comprises a hull 28 provided with drive means 26, and a working deck 29, the hull 28 being submersible into an operating position By connecting means, the working deck 29 is connected to the hull 28 with settable intermediate distance, such that the working ship is adjustable between a transport position in which the working deck 29 is located adjacent the hull 28, and a semi-submersed position in which the working deck is spaced from the hull 28, above the water line 5, and the hull 28 is located substantially below the water line 5. The hull 28 comprises a central working column 30 in which a guide conduit 31 is provided. In FIG. 5, the working ship is shown in its operating position. Within the guide conduit 31 there is arranged a float 12 for axial movement. The guide conduit 31 acts as guide. The constructional effect and the operating principle of the float and the guide are substantially as already explained hereinabove with reference to FIGS. 1, 2*a* and 2*b*. For a further discussion of the working ship, reference is made to applicant's currently prosecuted Dutch patent application No. 1010884.

It is observed that the float and/or the guide is preferably manufactured from high-strength steel, for instance steel having a yield point of at least 800 N/mm$^2$, more preferably having a yield point of at least 1100 N/mm$^2$. Such type of steel is commercially available under the name of Weldox 1100 from the firm SSAB of Oxelösund, Sweden.

It is further observed that the invention is not limited to the preferred embodiments discussed hereinabove. For instance, the float may also be coupled to the riser construction in another fashion, for instance by means of cooperating stops. Further, the float may comprise several parts. Moreover, the float may be designed without a bore for guiding the riser construction therethrough, for instance when the riser construction is passed along the float. In addition, the sidewalls of a central bore may extend outwards at a greater angle. This is advantageous in particular when riser segments are used whose sidewalls could become damaged when pressed against the sidewalls of the bore. Also, the guide may be designed other than as a guide conduit, for instance as an open guide having a number of guide rails or as a central guide rod around which the float is guided. In addition, the float need not necessarily be closed at its bottom side, but the bottom side of the float may also be open. Moreover, other types of length-adjustable connections between the float and/or the guide and the offshore construction may be used, such as winch cables running along pulleys or guideways.

Further, the section of the float and the guide may be of oval, triangular or polygonal design to prevent axial rotation in the guide. Also, said section may even be circular when there is, for instance, provided a projection which cooperates with a guide to prevent axial rotation.

Such variations will be readily understood by a skilled person and are considered to fall within the framework of the invention as set forth in the following claims.

What is claimed is:

1. A floating offshore construction, comprising a suspension gear for suspending a riser construction, the suspension gear being arranged to transmit downward force exerted by a riser construction on the offshore construction and comprising a hoisting gear for supporting the riser construction and a guide which, during use, extends adjacent the water surface, characterized in that the suspension gear further comprises a float arranged for axial movement in the guide, the float being provided with a coupling device for receiving the riser construction, and in that the suspension gear further comprises a length-adjustable connecting device connecting the guide to the float.

2. A floating offshore construction according to claim 1, wherein the guide comprises a conduit and the float comprises a sleeve provided with a floating chamber, said sleeve being accommodated in the conduit for axial movement.

3. A floating offshore construction according to claim 1, wherein the float is accommodated in the guide so as to be secured against axial rotation.

4. A floating offshore construction according to claim 1, wherein the float comprises a floating chamber with controllable ballast means.

5. A floating offshore construction according to claim 1, wherein the float has a central bore with sidewalls for guiding a riser construction therethrough.

6. A floating offshore construction according to claim 1, wherein the float is detachably connected to the guide.

7. A floating offshore construction according to claim 1, wherein the guide is connected to the offshore construction so as to be height-adjustable to a position above the water surface.

8. A floating offshore construction according to claim 2, wherein the float is accommodated in the guide so as to be secured against axial rotation.

9. A floating offshore construction according to claim 8, wherein:

the float comprises a floating chamber with controllable ballast means;

the float has a central bore with sidewalls for guiding a riser construction therethrough;

the float is detachably connected to the guide; and the guide is connected to the offshore construction so as to be height-adjustable to a position above the water surface.

* * * * *

UNITED STATES PATENT AND TRADEMARK OFFICE

CERTIFICATE OF CORRECTION

PATENT NO. : 6,752,213 B1
APPLICATION NO. : 09/913620
DATED : June 22, 2004
INVENTOR(S) : Hans van der Poel It is certified that error appears in the above-identified patent and that said Letters Patent is hereby corrected as shown below:

Column 1,
Line 32, delete “it”;

Column 2,
Line 27, delete “at”;

Column 4,
Line 53, “13 The” should read -- 13. The --;

Column 5,
Line 6, “semi-submersible FIG.” should read
-- semi-submersible. FIG. --;
Line 30, “means 26 The” should read -- means 26. The --;
Line 47, “position By” should read -- position. By --.

Signed and Sealed this

Twenty-seventh Day of June, 2006

JON W. DUDAS
*Director of the United States Patent and Trademark Office*